US006823700B1

(12) United States Patent
Yi

(10) Patent No.: US 6,823,700 B1
(45) Date of Patent: Nov. 30, 2004

(54) PILE YARN PROCESSED WARP KNIT FABRIC DIVIDED INTO A PLURALITY OF UNIFIED WARP KNIT FABRICS BY CUTTING PORTIONS

(75) Inventor: Kang Moon Yi, 116-1001 Dong-Aha A.P.T. 923 Dong-Choon Dong Yeon-Soo Gu, In-Cheon City (KR)

(73) Assignees: Kang Moon Yi (KR); New Clean Co., Ltd. (KR)

( * ) Notice: Subject to any disclaimer, the term of this patent is extended or adjusted under 35 U.S.C. 154(b) by 0 days.

(21) Appl. No.: 10/643,084

(22) Filed: Aug. 19, 2003

(51) Int. Cl.[7] ..... D04B 23/08
(52) U.S. Cl. ..... 66/192
(58) Field of Search ..... 66/192, 193, 195, 66/176, 196; 442/312–314

(56) References Cited

U.S. PATENT DOCUMENTS

| | | | | | |
|---|---|---|---|---|---|
| 2,657,159 | A | * | 10/1953 | Nahman | 2/243.1 |
| 3,985,003 | A | * | 10/1976 | Reed | 66/196 |
| 4,682,479 | A | * | 7/1987 | Pernick | 66/176 |
| 4,920,769 | A | * | 5/1990 | Rickerl | 66/176 |
| 5,081,854 | A | * | 1/1992 | Lonati | 66/176 |
| 5,797,283 | A | * | 8/1998 | Kaczmarczyk | 66/193 |
| 6,389,850 | B1 | * | 5/2002 | Fujiwara | 66/176 |
| 6,401,498 | B1 | * | 6/2002 | Fujiwara | 66/195 |
| 6,453,705 | B2 | * | 9/2002 | Fujiwara | 66/176 |

FOREIGN PATENT DOCUMENTS

| | | | |
|---|---|---|---|
| KR | 1019840001345 | B1 | 9/1984 |
| KR | 1020000270234 | B1 | 7/2000 |
| KR | 1020010012028 | A | 2/2001 |

* cited by examiner

*Primary Examiner*—Danny Worrell
(74) *Attorney, Agent, or Firm*—Fleshner & Kim, LLP

(57) ABSTRACT

A pile yarn processed warp knit fabric comprises a unified wrap knit fabric including a group of wales grouped in a predetermined number, in which weft yarns are inlaid in grouped wales in a wale direction to form a loop turning around the connecting portions between wales in an alternative arrangement with some weft yarns being superposed upon each another, and pile yarns are inserted in grouped wales to intersect the connecting points between the wales in a staggered form; a plurality of wale oriented cutting portions, in which a single weft yarn connects opposite grouped wales in neighboring unified warp knit fabrics to each another widthwise in a staggered form; and course oriented cutting portions, in which single weft yarn and single pile yarn extended from the unified warp knit fabric are inserted in wales adjacent the unified warp knit fabrics in a staggered form. Therefore, a pile yarn processed warp knit fabric is divided into a plurality of unified warp knit fabrics by wale oriented cutting portions and course oriented cutting portions. These cutting portions enable the edge wales of the unified warp knit fabric to prevent the separation of the loop yarns constituted as the edge wales of the unified warp knit fabrics. It means that additional sewing is not required, the loss of the pile yarn processed warp knit fabric is reduced and the original form of the unified wrap knit fabric is kept. It can provide the useful effects of creating high additional value including the reduction of manufacturing cost, etc.

5 Claims, 2 Drawing Sheets

PILE YARN PROCESSED WARP KNIT FABRIC DIVIDED INTO A PLURALITY OF UNIFIED WARP KNIT FABRICS BY CUTTING PORTIONS

BACKGROUND OF THE INVENTION

The invention is related to providing a pile yarn processed warp knit fabric comprising a plurality of unified warp knit fabrics divided by wale oriented cutting portions and course oriented cutting portions.

The pile yarn processed warp knit fabric comprises a plurality of unified warp knit fabrics, wale oriented cutting portions, in which a single weft yarn connects opposite grouped wales in neighboring unified warp knit fabrics to each another widthwise in a staggered form, and course oriented cutting portions, in which single weft yarn and single pile yarn extended from the unified warp knit fabric are inserted in wales adjacent the unified warp knit fabrics in a staggered form.

Generally, a knitted warp fabric is manufactured by the connection of loops to each another. It has many advantages in that the knitted warp fabric has the good sense of the touch, the good elasticity, no wrinkles, and good heat insulation by the entrapping of air and the good permeability. But, it has disadvantages in that the loops of the cutting portion are easily loosed, the knitted warp fabric is easily changed in its original form and the cut portion is necessarily sewed with much carefulness.

In other words, the knitted warp fabric must be cut in a predetermined size without processing edges for its use and then stitched using an overlock machine, but it is difficult to keep the original form of a knitted warp fabric in spite of being overlock-stitched. In a bad case, the knitted warp fabric may be changed not to come back to its original form.

In order to resolve these problems, a typical technology is disclosed in Korean Patent No. 270,234 entitled "a method of finishing knitted cleaner and knitted cleaner therefrom". The knitted cleaner processed with upper and lower loops include warpers put on edges to each another. The warpers are covered with overlock stitches to be held to the knitted cleaner. It prevents the separation of the knitting edges to maintain the original form of knitting. But, the patent needs separate warpers and overlock stitches which additional processing procedures are required following by the rising of the manufacturing cost.

Another Korean Patent No. 301,311 is related to a process for preparing a warp knit fabric having the effect of a crepe, which comprises steps of preparing raw yarns used for gray fabric of fibers, warping a plurality of raw yarns on one beam, weaving a plurality of raw yarns wound by the warping process and dyeing the obtained gray fabric. The process further includes a sewing process for sewing end parts of the raw gray to prevent the end parts of a weave fabric from being rolled up and a dyeing process. But, the sewing process is very troublesome in works and the end parts of the weave fabric are easily changed. The additional procedures accompany the increased manufacturing cost.

Another Korean Examined Publication No. 1984-1345 corresponding to EP37628B1 discloses a production of knitted garments, in which a succession of integrally-joined blanks each has an integral welt or selvedge separable from the next blank by a draw thread at one end thereof. After knitting, the blanks are flattened, pre-shrunk and separated in a single steam-soluble draw thread operation. An end of the welt is shaped to form two superposed identical portions.

There is no need for a separate hemming operation and the make-up. But, the patent must be processed to have the welt or selvedge following by the rising of the manufacturing cost due to additional welt forming procedures.

An object of the invention is to provide a pile yarn processed warp knit fabric divided into a plurality of unified warp knit fabrics by wale oriented cutting portions and course oriented cutting portions.

SUMMARY OF THE INVENTION

In order to resolve these and those problems, according to the invention, a pile yarn processed warp knit fabric comprises a unified warp knit fabric including a group of wales grouped in a predetermined number, in which weft yarns are inlaid in grouped wales in a wale direction to form a loop turning around the connecting portions between wales in an alternative arrangement with some weft yarns being superposed upon each another, and pile yarns are inserted in grouped wales to intersect the connecting points between the wales in a staggered form; a plurality of wale oriented cutting portions, in which a single weft yarn connects opposite grouped wales in neighboring unified warp knit fabrics to each another widthwise in a staggered form; and course oriented cutting portions, in which single weft yarn and single pile yarn extended from the unified warp knit fabric are inserted in wales adjacent the unified warp knit fabrics in a staggered form. Therefore, a pile yarn processed warp knit fabric is divided into a plurality of unified warp knit fabrics by wale oriented cutting portions and course oriented cutting portions.

BRIEF DESCRIPTION OF THE DRAWINGS

The invention now will be described in detail below with reference to the attaching drawings, in which.

DETAILED DESCRIPTION OF THE INVENTION

Figure 1:
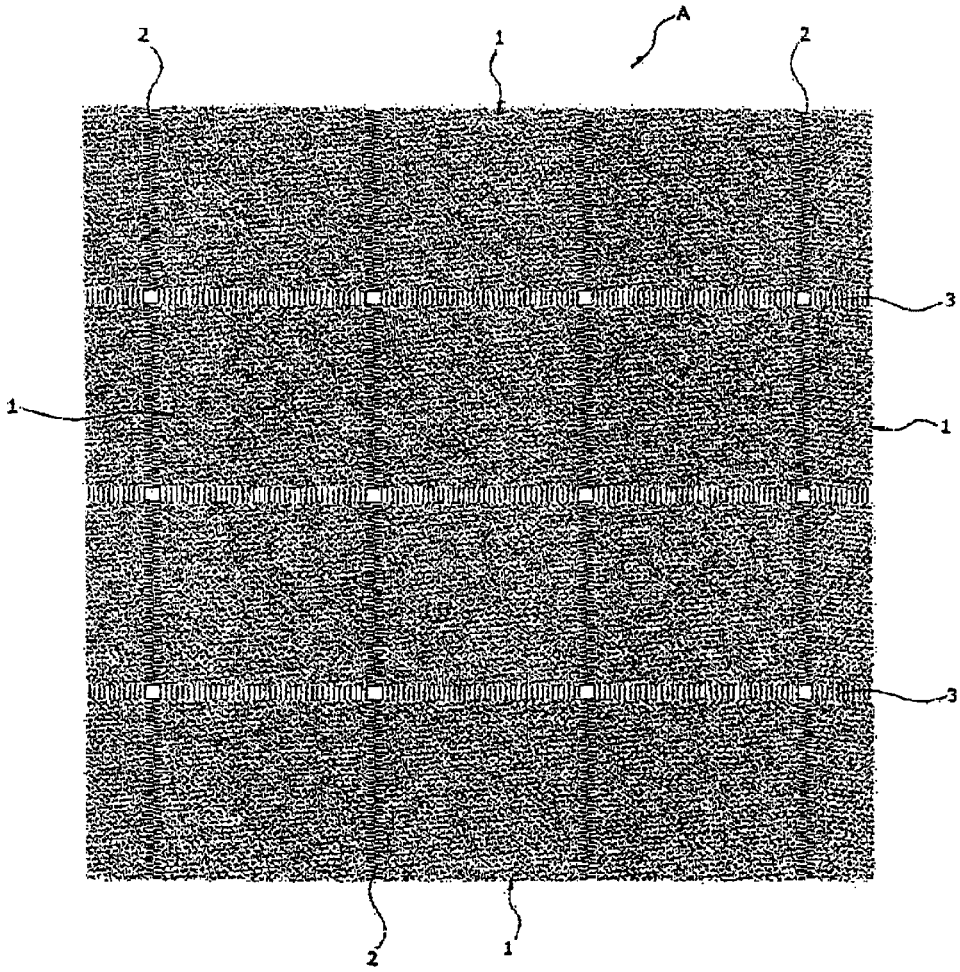
FIG. 1 is a front view illustrating a pile yarn processed warp knit fabric divided into a plurality of unified warp knit fabrics by cutting portions according to the invention; and, FIG. 2 is an enlarged fragmentary isometric view illustrating a pipe yarn processed warp knit fabric according to the invention.
Figure 2:
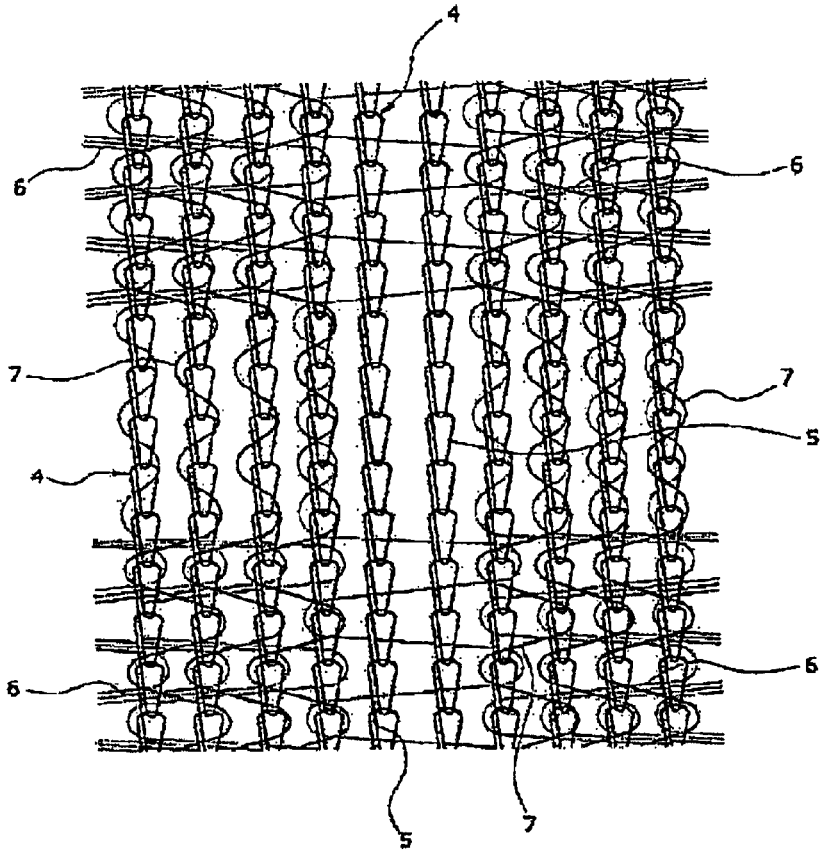

Referring to the drawings, the invention comprises a pile yarn processed warp knit fabric A, called an integrated garment below, including a plurality of unified warp knit fabrics 1, wale oriented cutting portions 2 and course oriented cutting portions 3. The unified warp knit fabric 1 is divided by wale directional cutting portions 2 and course directional cutting portions 3 on the integrated garment A. The integrated garment A comprises a warp knit fabric 1 as a base member of the unified warp knit fabrics 1, the wale oriented cutting portions 2 and the course oriented cutting portions 2. The base member includes a plurality of wales 4 to be divided into many groups, each of which is constituted as loop yarns 5 to be formed lengthwise in numerous lines and widthwise in numerous rows. The unified warp knit fabric 1 includes a group of wales 4 having a predetermined area. The wales 4 are grouped in a predetermined number, in which weft yarns 6 are inlaid in a wale direction to form a loop turning around the connecting portions between wales 4 in an alternative arrangement. In the course of the inlaying, some weft yarns 6 may be superposed upon each another in double or more and not be. On the same time, the wales 4 are grouped in two or more lengthwise, in which pile yarns 7 are inserted to intersect the connecting points between the wales in a staggered form. A pile portion using the pile yarns 7 might be formed on one side surface or both surfaces of the base member, its form of which is not limited to any other format. Therefore, if the plurality of pile yarns 7 are additionally inserted into each of wales 4 to be staggered to each another, it is noted that the pile yarns 7 and the wales 4 are tied up with each another to secure their hard binding and prevent the unloosing among the wales 4.

On the other hand, the integrated garment A comprises further the wale oriented cutting portion 2 and the course oriented cutting portion 3 that are formed in the course of knitting the unified warp knit fabric 1. The wale oriented cutting portion 2 means wale portions between neighboring unified warp knit fabrics 2 widthwise, in which the wale portion includes a plurality of wales 4 formed as loop yarns 5. The wales 4 are coupled to each another using additional single weft yarn 6. For example, the single weft yarn 6 is continuously intersected in a staggered form, turning around the opposite connecting points of edge wales in neighboring unified warp knit fabrics 1. Therefore, upon being cut, only the additional single weft yarn is cut to keep the original form of the unified warp knit fabric 2 without damaging the loop yarns 5, the weft yarns 6 and the pile yarns 7. The edge loops of the unified warp knit fabric 1 are unloosed.

And, a general warp knit fabric is easily loosed. The reason is because loop yarns or weft yarns and pile yarns that are a floating thread are woven in at least two wales. In order to overcome this disadvantage, the course oriented cutting portion 3 is formed as wale portions between neighboring unified warp knit fabrics 1 lengthwise, in which the wale portion includes a plurality of wales 4 formed as loop yarns 5. Single weft yarn 6 and single pile yarn 7 are alternatively intersected in a staggered form to each other turning around the connecting points of wales 4 that are extended lengthwise adjacent edge wales 4 of neighboring unified warp knit fabrics 1. Therefore, the wales 4 are knitted independent of wales 4 in the unified warp knit fabrics 1. For it, upon being cut, the edge loop yarns 5 in the unified warp knit fabric 1 are not damaged. In that case, the wale 4, the weft yarn 6 and the pile yarn 7 are tied up to each another in a hard binding state. It prevents the separation of the edge wales in the unified warp knit fabrics 1.

Therefore, the invention need not separate sewing of the edge wales of the unified warp knit fabric 1, when the integrated garment A is cut into the unified warp knit fabrics 1. It keeps the original form of the unified warp knit fabric 1 without additional expense.

Until now, the invention was explained as a configuration that a pile yarn processed warp knit fabric A comprises a plurality of unified warp knit fabrics 1 that can be divided by wale oriented cutting portions 2 and course oriented cutting portions 3.

In addition to above embodiment, another embodiment can be accomplished by a configuration that a pile yarn processed warp knit fabric A comprises a plurality of unified warp knit fabrics 1 that can be divided only by wale oriented cutting portions 2 or only by course oriented cutting portions 3. The unified warp knit fabric 1 may be formed using only weft yarns and loop yarns except pile yarns.

As described above, the invention comprises wale oriented cutting portions, in which a single weft yarn connects opposite grouped wales in neighboring unified warp knit fabrics to each another widthwise in a staggered form, and course oriented cutting portions, in which single weft yarn and single pile yarn extended from the unified warp knit fabric are inserted in wales adjacent the unified warp knit fabrics in a staggered form. Therefore, a pile yarn processed warp knit fabric is divided into a plurality of unified warp knit fabrics by wale oriented cutting portions and course oriented cutting portions. These cutting portions enable the edge wales of the unified warp to prevent the separation of the loop yarns constituted as the edge wales of the unified warp knit fabrics. It means that additional sewing is not required, the loss of the pile yarn processed warp knit fabric is reduced and the original form of the unified warp knit fabric is kept. It can provide the useful effects of creating high additional value including the reduction of manufacturing cost, etc.

What is claimed is:

1. A pile yarn processed warp knit fabric including a plurality of unified warp knit fabrics comprising:

the unified warp knit fabrics including a plurality of wales to be divided into many groups, each of which is constituted as loop yarns to be formed lengthwise in numerous lines and widthwise in numerous rows, in which weft yarns are inlaid in grouped wales in a wale direction to form a loop turning around the connecting portions between wales in an alternative arrangement with some weft yarns being superposed upon each another in double or more, and pile yarns are inserted in lengthwise grouped wales to intersect the connecting points between the wales in a staggered form;

a wale oriented cutting portion formed between neighboring unified warp knit fabrics widthwise, in which a single weft yarn is continuously intersected in a staggered form, turning around the opposite connecting points of edge wales in neighboring unified warp knit fabrics; and a course oriented cutting portion formed as wale portions between neighboring unified warp knit fabrics lengthwise, in which single weft yarn and single pile yarn are alternatively intersected in a staggered form to each other turning around the connecting points of wales that are extended lengthwise adjacent edge wales of neighboring unified warp knit fabrics thereby enabling a plurality of unified warp knit fabrics to be divided by wale oriented portions and course oriented cutting portions.

2. The pile yarn processed warp knit fabric as claimed in claim 1, in which:

the pile yarns are used to form a pile portion formed on one side surface or both surfaces of the grouped wales.

3. The pile yarn processed warp knit fabric as claimed in claim 1, in which:

the pile yarn processed warp knit fabric comprises a plurality of unified warp knit fabrics that can be divided only by wale oriented cutting portions or only by course oriented cutting portions, and the unified warp knit fabric is formed using only weft yarns and loop yarns except for pile yarns.

4. The pile yarn processed warp knit fabric as claimed in claim 1, in which:

the wale oriented cutting portion is formed so that a single weft yarn connects opposite grouped wales in neighboring unified warp knit fabrics to each another widthwise in a staggered form.

5. The pile yarn processed warp knit fabric as claimed in claim 1, in which:

the course oriented cutting portion is formed so that the single weft yarn and single pile yarn extended from the unified warp knit fabric are inserted in wales adjacent the unified warp knit fabrics in a staggered form.

* * * * *